United States Patent [19]

Viner

[11] 4,156,985

[45] Jun. 5, 1979

[54] PNEUMATIC DOLL

[75] Inventor: Peter Viner, The Chase, England

[73] Assignee: General Mills U.K. Limited, Wetherby, England

[21] Appl. No.: 837,327

[22] Filed: Sep. 27, 1977

[30] Foreign Application Priority Data

Sep. 28, 1976 [GB] United Kingdom ..... 40156/76

[51] Int. Cl.[2] ..... A63H 29/16

[52] U.S. Cl. ..... 46/44; 46/119; 46/173

[58] Field of Search ..... 46/119, 118, 128, 44, 46/163, 173

[56] References Cited

U.S. PATENT DOCUMENTS

| | | | |
|---|---|---|---|
| 1,326,790 | 12/1919 | Schoenhut | 46/173 |
| 3,594,942 | 7/1971 | Hollingsworth | 46/128 X |
| 3,603,029 | 9/1971 | Nutting | 46/118 UX |
| 3,757,463 | 9/1973 | Breslow et al. | 46/44 X |
| 3,911,616 | 10/1975 | Pelfrey | 46/128 |

FOREIGN PATENT DOCUMENTS

| | | | |
|---|---|---|---|
| 548793 | 10/1956 | Italy | 46/119 |

*Primary Examiner*—Russell R. Kinsey
*Assistant Examiner*—Mickey Yu
*Attorney, Agent, or Firm*—Sughrue, Rothwell, Mion, Zinn and Macpeak

[57] ABSTRACT

A doll has a head, torso and limbs. One of the limbs is jointed to provide a distal portion which is pivotal relative to a proximal portion. Pneumatic operating devices are provided for effecting the pivotal motion and these include an actuator which is manually operable and pneumatically connected to a pressure responsive member accommodated in the proximal limb portion. The actuator is a variable volume member such as a pressure bulb which may take the form of one of the other limbs of the doll. The pressure responsive member is connected to the distal limb portion by a connector in such a way that operation of the pressure responsive member by the actuator causes pivotal movement of the distal limb portion. In a preferred embodiment, the pressure responsive member is located in the upper portion of one of the arms and the movement of the lower arm effected thereby causes the lower arm to move towards the face and give the impression of blowing a kiss on its return movement.

2 Claims, 6 Drawing Figures

PNEUMATIC DOLL

This invention relates to dolls or the like.

According to the present invention there is provided a doll comprising a head, a torso and limbs, at least one of said limbs being jointed to provide a distal portion pivotal relative to a proximal portion, pneumatic operating means for effecting said pivotal motion, said means including a manually operable, variable volume, actuator in pneumatic connection with a pressure responsive member accommodated in said proximal limb portion, and connecting means for connecting said pressure responsive member to the distal limb portion so as to cause pivotal movement thereof on manual operation of the actuator.

The invention will now be further described by way of example only, with reference to the accompanying drawings, in which.

Figure 1:
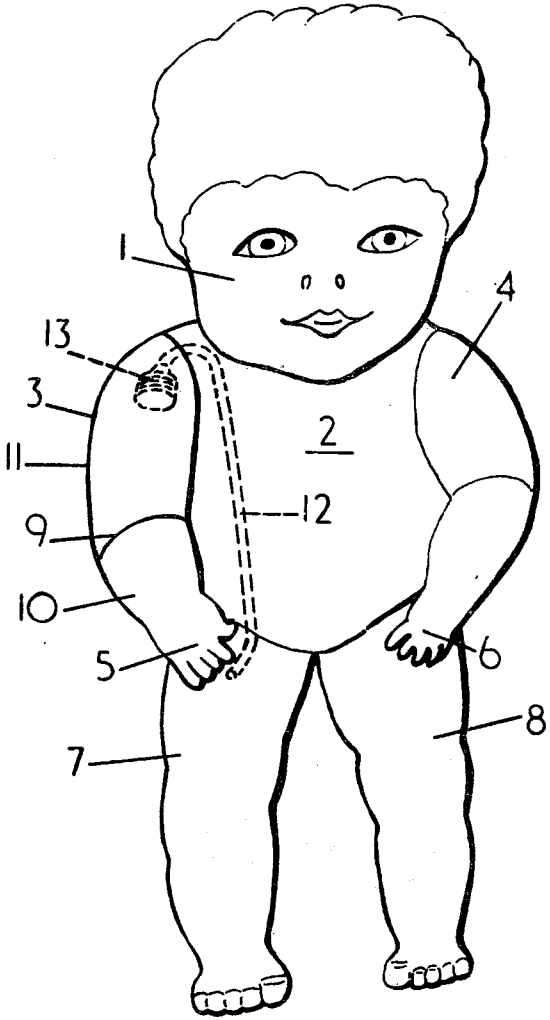
FIG. 1 is a diagram of a doll showing part of the pneumatic operating means of the present invention.
Figure 6:
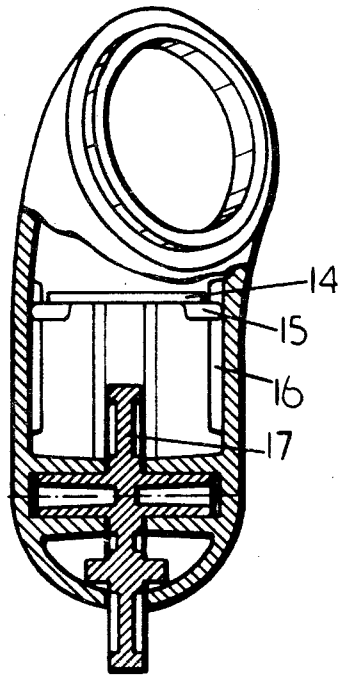
FIG. 6 is a section on line A—A of FIG. 3.

Referring now to the drawings, the doll illustrated in FIG. 1 comprises a head 1, a torso 2, arms 3 and 4 with respective hands 5 and 6, and legs 7 and 8. The arm 3 is jointed at the elbow 9 to enable pivotal movement of the forearm or distal arm portion 10 relative to the upper or proximal arm portion 11. Pneumatic operating means for effecting the pivotal movement are diagrammatically illustrated in FIG. 1 and are seen to comprise a variable volume actuator in the form of deformable leg 7 connected by a tube 12 to a pressure responsive member in the form of a bellows 13. It will be appreciated that the leg 7 constitutes an airtight enclosure save for the connection with the tube 12. In effect, the leg 7 is a pressure bulb which has been shaped into the form of a doll's leg.

Figure 3:
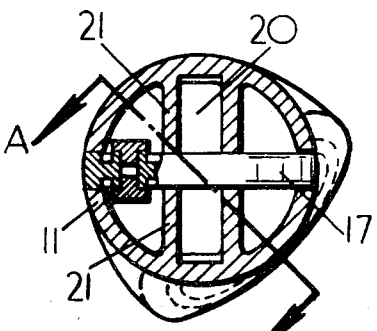
FIG. 3 is a section on line D—D of FIG. 2.
Figure 4:
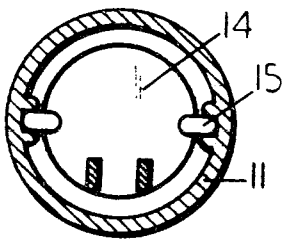
FIG. 4 is a section on line C—C of FIG. 2.
Figure 2:
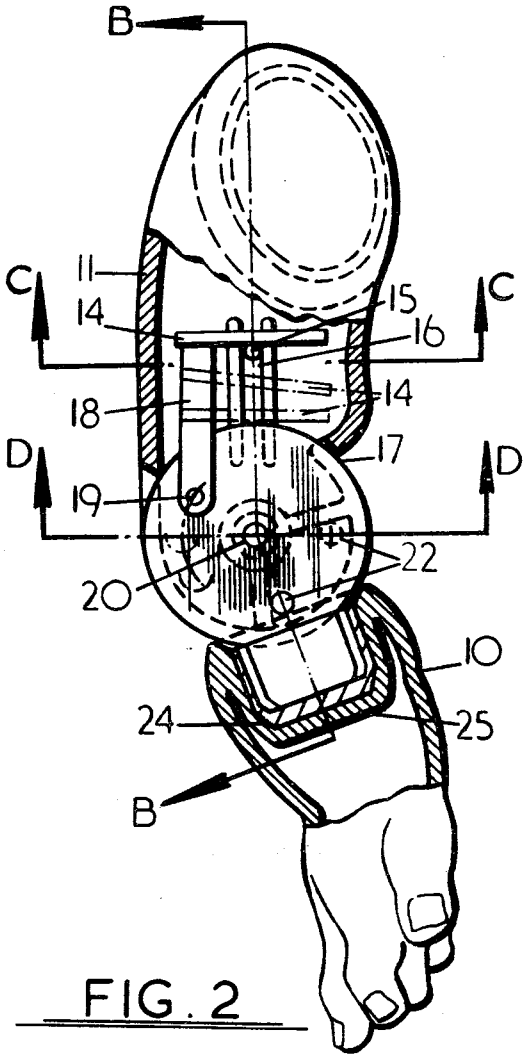
FIG. 2 is a part sectional view of an arm of the doll.
Figure 5:
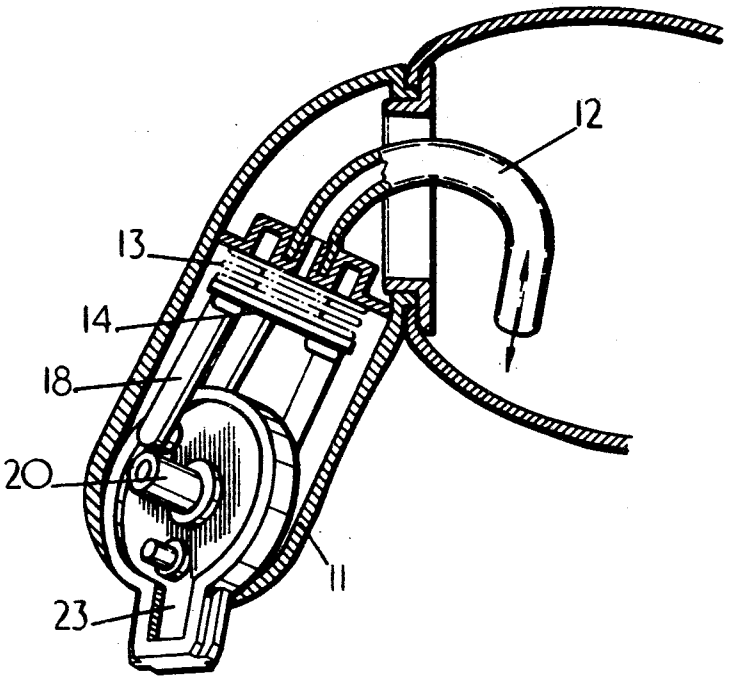
FIG. 5 is a section on line B—B of FIG. 2.

The bellows member 13 of the pneumatic operating means is illustrated in FIG. 5 and is connected at its end remote from the tube 12 to a pressure plate 14 constituting part of the connecting means for connecting the bellows member 13 to the distal limb portion 10. Pressure plate 14 is also shown in FIG. 2 in its rest position (in full line) and its fully extended position and an intermediate position (in broken line). The pressure plate 14 is provided at diametrically opposed locations with lugs 15 engaging in respective grooves 16 for guiding the pressure plate 14 during its movement. The pressure plate 14 is connected to a rotary member 17 by a stirrup connection 18 pivoted on the rotary member at a pivot point 19. The rotary member 17 is in the form of a wheel with an integral arbour 20 journalled in bearings 21 at opposite sides of the lower end of the upper arm moulding. The stirrup or connecting member 18 and the wheel 17 thus constitute a crank mechanism operated by the bellows member 13 under the influence of the actuator connected thereto by the tube 12.

The wheel 17 has an integral stop 22 projecting to opposite sides thereof and movable between the two positions illustrated in broken line in FIG. 2. The wheel 17 is thus limited in its rotation to an arc of about 90°. The wheel 17 also has an integral projection 23 best seen in FIG. 5 on which is mounted a cylindrical cap 24 which serves as a spigot for reception in a corresponding socket 25 in the distal portion 10 of the arm.

To cause pivotal movement of the forearm 10, the leg 7 is squeezed thus causing the bellows member 13 to expand under the influence of the air displaced from the leg 7 through the tube 12. The proximal end of the bellows 13 is anchored and the expansion of the bellows member 13 thus causes the pressure plate 14 secured to its distal end to move in the direction towards the wheel 17. When the pressure on the leg 7 is relieved air returns into the leg from the bellows member and the movement of the pressure plate 14 is reversed. This movement of the pressure plate 14 is translated into rotary motion of the wheel 17 by virtue of the stirrup connection 18. Because of the spigot and socket connection between the rotary member 17 and the forearm 10 the latter is thereby caused to move between the extreme positions defined by the stop 22 engaging the abutments on the moulded upper arm.

The arrangement is such that the forearm 10 can move between the relaxed position shown in FIG. 1 (in full line in FIG. 2) and the fully bent position shown in dotted line in FIG. 2. In this latter position the forearm 10 is in close proximity to the mouth of the doll and the return movement of the forearm 10, as the pressure on the leg 7 is relieved, gives the impression that the doll is blowing a kiss.

It will be appreciated that numerous modifications may be made to the embodiment described above without departing from the scope of the invention. For example, the actuator whose deformation causes the bellows member to effect movement of the lower arm need not necessarily be constituted by one of the legs of the doll and could, for example, be the other arm or the torso of the doll. Alternatively, the pressure bulb might be a separate component accommodated within one of the other limbs or the torso of the doll and it is even possible that the pressure bulb might be located remote from the doll.

Both the pressure bulb and the bellows member could be replaced by equivalent means such as piston and cylinder mechanisms in which case the pneumatic system would comprise a master cylinder constituting the actuator and a slave cylinder constituting the pressure responsive member.

It will also be appreciated that the arrangement described with reference to the drawings may be duplicated in the sense that the other arm may similarly be equipped with a bellows portion arranged to be operated by an actuator located in or constituted by the other leg of the doll.

It is also within the contemplation of the invention that the pressure responsive member may be located in the proximal portion of one of the legs so as to cause a kicking action of the lower leg when operated by the actuator.

It will be appreciated that various combinations of the alternatives described above are feasible. For example, it is possible to have an arrangement in which pressure on one of the arms causes kicking of one of the legs whereas pressure on the other leg causes movement of the other arm.

In the described embodiment the pivotal motion of the lower arm brings the hand into close proximity with the mouth of the doll and return movement of the lower arm gives the impression of the doll blowing a kiss. In an alternative arrangement, the forearm of the doll may be movable towards and away from the head of the doll such that the respective hand covers and uncovers the eyes of the doll. In this case, the doll preferably incorporates closable eyes and a tearing (crying) mechanism is incorporated into the doll. The arrangement is such that movement of the hand to cover and uncover the eyes of the doll actuates the tearing mechanism, thus providing the overall effect that the doll is covering the tearing eyes with its hand. Of course, if both arms are jointed and equipped with pressure responsive members it is possible for both hands to cover the eyes thereby enhancing the effect.

The pneumatic connection between the actuator and the pressure responsive member may incorporate a sound producing unit which, in the case of the illustrated embodiment, would be adapted to produce a "kissing" sound while the hand is in the vicinity of the mouth. In other embodiments it may be preferable to produce a crying sound, e.g. where the movement of the arm causes the hand to cover and uncover the eyes.

A further variation is the provision of a single actuator connected to two or more pressure responsive members. For example, a pressure bulb actuator may be provided by or accommodated for the doll's torso and be pneumatically connected to two pressure responsive members located in respective arms. Manual pressure on the torso would thus cause both forearms to move towards the head.

What is claimed is:

1. A doll comprising a head, a torso, two arms and two legs, at least one of said arms being rotatably connected to said torso to provide a rotatable shoulder joint and having a pivoted elbow joint intermediate the end of said arm whereby a distal portion of said arm may be pivoted relative to a proximal portion of said arm, pneumatic operating means for effecting said pivotal motion including a manually operable, variable volume actuator in pneumatic connection with a pressure responsive member disposed in said proximal limb portion, said actuator being comprised of a deformable pressure bulb formed by one of the other limbs or the torso, said pressure responsive member being comprised of a bellows member having one end secured in said proximal limb portion with the other end thereof being movable along the length of said proximal limb portion and connecting means for connecting said pressure responsive member to said distal limb portion so as to cause pivotal movement thereof upon manual operation of the actuator comprising a connecting rod connected at one end to said other end of said bellows member and at the other end to a rotary member attached to said distal limb portion and rotatable about said pivoted elbow joint.

2. A doll as set forth in claim 1, wherein the rotary member is connected to said distal limb portion by a spigot and socket connection.

* * * * *